United States Patent [19]

Bourquard

[11] 4,118,923

[45] Oct. 10, 1978

[54] PUSH-BUTTON ASSEMBLY AND MANUFACTURING METHOD

[75] Inventor: Pierre Bourquard, Boecourt, Switzerland

[73] Assignee: Pibor S.A., Switzerland

[21] Appl. No.: 732,665

[22] Filed: Oct. 15, 1976

[30] Foreign Application Priority Data

Oct. 20, 1975 [CH] Switzerland ..... 75/13551
Feb. 24, 1976 [CH] Switzerland ..... 76/2241

[51] Int. Cl.[2] ..... G04B 37/00

[52] U.S. Cl. ..... 58/88 B; 29/177; 29/436; 29/453; 403/166

[58] Field of Search ..... 403/166; 29/453, 436, 29/177; 200/159 R; 58/23 R, 88 B

[56] References Cited

U.S. PATENT DOCUMENTS

| | | | |
|---|---|---|---|
| 2,894,779 | 7/1959 | Kushner et al. | 403/166 X |
| 2,941,511 | 6/1960 | Cieremans | 29/453 X |
| 3,123,351 | 3/1964 | Graber | 403/166 X |
| 3,251,971 | 5/1966 | Fraser | 29/453 X |
| 3,285,428 | 11/1966 | Scheck | 29/453 UX |
| 3,928,741 | 12/1975 | Comer | 200/159 R |
| 3,939,318 | 2/1976 | Brown et al. | 200/159 R |
| 3,974,351 | 8/1976 | Solov | 58/23 R X |
| 3,977,178 | 8/1976 | Brown et al. | 58/88 B X |

FOREIGN PATENT DOCUMENTS

| | | | |
|---|---|---|---|
| 1,506,207 | 11/1967 | France | 58/88 B |

*Primary Examiner*—Charlie T. Moon
*Attorney, Agent, or Firm*—Robert E. Burns; Emmanuel J. Lobato; Bruce L. Adams

[57] ABSTRACT

A timepiece push-button assembly, in which a push-button and its stem are biased to a rest position defined by abutment of a shoulder of the stem against the end of its guide tube, is assembled with a snap fit by elastic deformation of a trunco-conical part of the stem forming said shoulder.

5 Claims, 5 Drawing Figures

PUSH-BUTTON ASSEMBLY AND MANUFACTURING METHOD

BACKGROUND OF THE INVENTION

The invention relates to a push-button assemblies in particular for timepieces, of the type comprising a guide tube receiving a stem of the push-button and a spring biasing the push-button and stem axially to a rest position defined by abutment of a part on said stem adjacent an operative end thereof externally with an abutment-forming end of the tube, said part of the stem being wider than the inner diameter of a bore in said abutment-forming end of the tube.

In known assemblies of this type, the push-button is usually screwed onto the stem which has a screw-head at its operative end. Assembly is achieved, after fitting the guide tube in, for example, a watch casing, by placing the spring in the tube, passing the stem from inside the watch case through the tube, and screwing the button on the outer end of the stem, the screw head of the stem coming to abut against the inner end of the tube to define the axial rest position of the button and stem. Screwing of the stem in the button is difficult since this must be carried out after fixing the tube on the watch or other casing.

An aim of the invention is to simplify the manufacture of such an assembly.

SUMMARY OF THE INVENTION

According to one aspect of the invention, a method of manufacturing a push-button assembly of the aforementioned type comprises the steps of providing a push-button with a stem of which said part adjacent its operative end is a shoulder defined by an elastically-deformable generally frusto-conical part tapering, from a shoulder-forming end of maximum diameter, towards said operative end, said frusto-conical part having a maximum outer diameter greater than the inner diameter of said bore but being elastically deformable to pass through said bore, inserting the stem through the spring and tube, and forcing said frusto-conical part fully through said bore with elastic deformation of said frusto-conical part by a coaction with said bore of the tube until said shoulder-forming end of maximum diameter reassumes its original dimensions and abuts against said end of the tube.

The invention also pertains to a push-button assembly of the aforementioned type wherein said part of the stem is a shoulder defined by an integral elastically-deformable generally frusto-conical part tapering, from a shoulder-forming end of maximum diameter, towards said operative end, said frusto-conical part having a maximum diameter greater than the inner diameter of said bore of the tube but being elastically deformable by coaction with said bore of the tube whereby it is assembled by forcing it through the bore of the tube.

BRIEF DESCRIPTION OF THE DRAWINGS

The accompanying drawings show, by way of example, a prior-art assembly and two embodiments of the invention. In the drawings.

DESCRIPTION OF THE PREFERRED EMBODIMENTS

Figure 1:
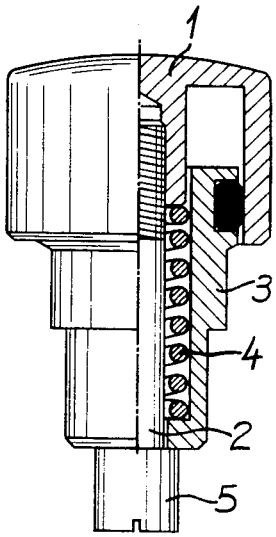
PRIOR ART FIG. 1
FIG. 1 is a part elevational and part cross-sectional view of a known push-button assembly.

FIG. 1 shows a conventional push button assembly including a control member (head) 1 fitted with a control stem 2, a guide tube 3 adapted to be fixed to a timepiece case, and a biasing spring 4 An axial rest position of the member 1 and head 2 is defined by a head 5 of the stem 2 which bears against the lower face of the guide tube 3 The usual assembly procedure involves placing the stem 2 through the bottom end of tube 3, placing the spring in the top end, and screwing on the head 1.

Figure 2:
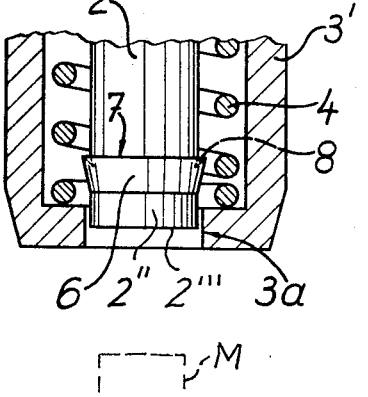
FIGS. 2 and 3 are partial views, in cross-section, of a first embodiment of the invention.
Figure 3:
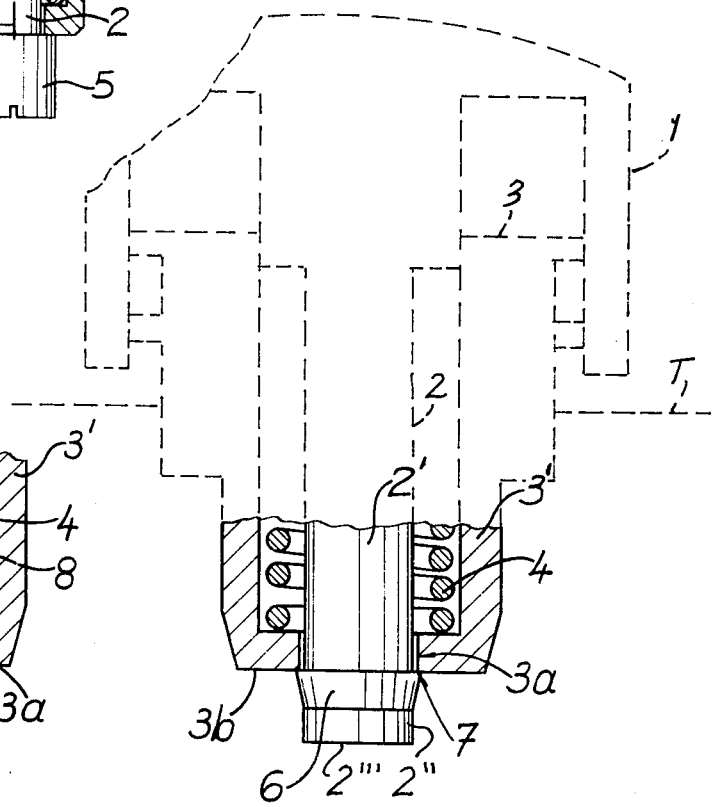

FIGS. 2 and 3 are partial cross-sections of a push button assembly according to the invention, during and after assembly. As in FIG. 1, the control stem is designated by 2, the guide tube to be fixed to the timepiece case T, by the reference character 3 and the biasing spring by 4. The control head 1 may be of any type, water-tight or otherwise; it may, as in FIG. 1, be screwed on the stem 2, or may advantageously be machined in one piece with the stem, as indicated in FIG. 3.

FIGS. 2 and 3 show the important feature of the invention: the operative end portion 2' of the stem 2 and the corresponding part 3' of tube 3 during and after assembly.

Adjacent its end, and as shown continuing a surface 2'', the stem 2 has a frustoconical part 6 which can be integral with the stem, as shown, and of which the larger end, defining a shoulder 7, has a diameter greater than the bore **3*a* of tube end portion 3' by several hundredths of a millimeter, the part 6 tapering from the shoulder end 7 to the cylindrical operative end of stem 2. This end, as shown, is smaller than the bore 3*a* and has a flat end surface 2'''**, this surface being continuous, that is, uninterrupted, as also shown.

For assembly, the stem 2 on which the head 1 is fitted is inserted through the spring 4 and tube 3 until its operative end and the narrow end of the frustoconical part 6 penetrate in the bore **3*a*. Then this frusto-conical part 6 is forced through the bore 3*a*. During this forcing, the edge of shoulder-forming end 7 of the frusto-conical part is elastically deformed by coaction with the bore 3*a* and after passage through the bore, reassumes its initial diameter greater than that of the bore, so that shoulder 7 bears on the lower face 3*b* of the tube 3 and hence defines the axial position of the stem 2 at rest. In use, the button 1 can be pressed in from this rest position, against the action of spring 4, for the actuation of a controlled member M by the operative end surface 2''** of the stem.

To facilitate elastic deformation of the frusto-conical part, it is possible to provide a circular undercut 8 in the shoulder forming end 7 of part 6, as indicated in a broken line in FIG. 2.

Figure 4:
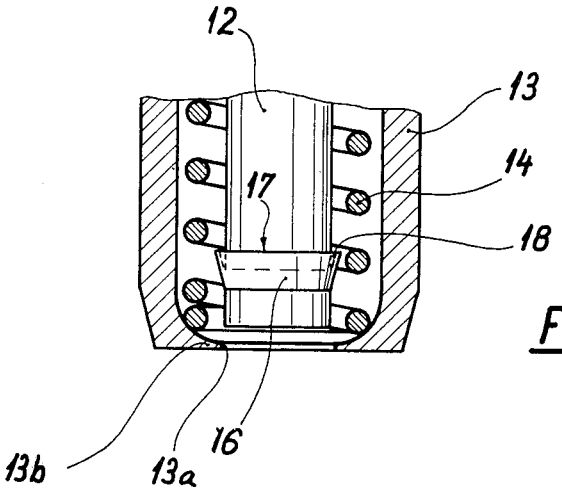
FIGS. 4 and 5 are similar views of a second embodiment of the invention.
Figure 5:
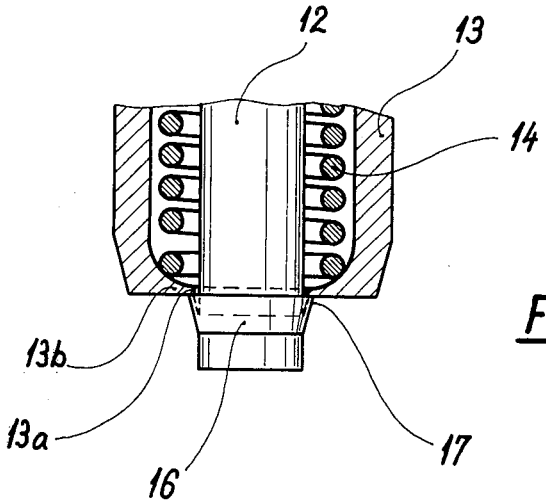

FIGS. 3 and 4 show the operative end of the stem 12 and the corresponding part of tube 13 during and after assembly of the second embodiment.

Adjacent the operative end of stem 12 is a frusto-conical part 16 whose large shoulder-forming end 17 has a diameter greater than that of the bore **13*a* of the end of tube 13** by several hundredths of a millimeter.

The bore **13*a* is formed by the edge of a relatively-narrow inwardly-projecting lip 13*b* formed on the tube 13 adjacent its lower face. The edge of the lip 13*b* may deform elastically by coaction with part 16** during assembly.

Assembly is as before, but during forcing of the part 16 through bore **13*a*, both the end 17 of the frusto-conical part 16 and the lip 13***b* deform elastically and then reassume their original diameters, thus forming a shoulder applying on the lower face of tube 13 and hence defining the axial position of the stem 12 at rest.

To facilitate this elastic deformation, it is possible, as in the first embodiment, to provide a circular undercut 18 in the shoulder forming end 17 of part 16, as indicated in a broken line in FIG. 2.

An advantage of the invention is that as the stem is fixed to the control head (1) before it is inserted in the guide tube, this fixing can be done not by screwing but by force-fitting, setting and/or sticking. The head and stem may also be made in a single machined piece. Assembly can take place, without difficulty, with the guide tube 3,13 already force-fitted in, for example, a watch case. Also, as the operative end surface 2'' of the stem need no longer be slotted (as was necessary for the conventional part 5 to enable it to be screwed), there is no risk of uncertain operation due to penetration of the controlled member M in any slot of the stem.

What is claimed is:

1. A method of manufacturing a push-button assembly of the type having a guide tube receiving a stem of the push-button and a spring biasing the push-button and stem axially to a rest position defined by abutment of a part on said stem adjacent an operative end thereof externally with an abutment-forming end of the tube, said part of the stem being wider than the inner diameter of a bore in said abutment-forming end of the tube, comprising the steps of providing a push-button with a stem of which said part adjacent its operative end is a shoulder defined by an elastically-deformable generally frusto-conical part tapering, from a shoulder-forming end of maximum diameter, towards said operative end, said frusto-conical part having a maximum outer diameter greater than the inner diameter of said bore but being elastically deformable to pass through said bore, inserting the stem through the spring and tube, and forcing said frusto-conical part fully through said bore with elastic deformation of said frusto-conical part by coaction with said bore of the tube until said shoulder-forming end of maximum diameter reassumes its original dimensions and abuts against said end of the tube.

2. A push-button assembly, comprising;

a push-button;

a stem rigid therewith, extending axially from a central part of the push-button to an operative end of the stem; and having a flat, continuous surface at the operative end;

a guide tube receiving the stem for axial movements of the stem along the guide tube, the guide tube having an abutment end remote from the push-button and having a bore in the abutment end;

a generally frusto-conical member integral with the stem adjacent the operative end, tapering toward that end, and having a shoulder end, of diameter greater than the bore of the guide tube, the frusto-conical member being elastically deformable, in a coaction thereof with the bore of the tube, by axially moving the pushbutton and stem in the original assembling of the assembly to force the frusto-conical member through the bore; and a spring in the guide tube, biasing the push button and stem axially to a rest position defined by abutment of the shoulder and of said member of the stem on the abutment end of the tube, for normally maintaining the rest position in the use of the assembly, subject to an axial movement of the push-button and stem, against the spring, in which movement the shoulder end becomes spaced from the abutment end, being thereafter resiliently returned by the spring to the abutment end.

3. An assembly according to claim 1 in which the stem is integral with the push-button.

4. An assembly according to claim 1 in which the guide tube is insertable in a casing of a timepiece, for control of a timepiece portion by the flat continuous surface at the operative end of the stem.

5. An assembly according to claim 1, in which the generally frustoconical member is circularly undercut, on the shoulder thereof, to enhance the elastic deformability of the member.

* * * * *